United States Patent [19]

Goss et al.

[11] 4,184,600

[45] Jan. 22, 1980

[54] METHOD FOR REMOVING A BEARING ASSEMBLY OF A PEDESTAL CRANE AND A REMOVABLE BEARING ASSEMBLY FOR A PEDESTAL CRANE

[76] Inventors: John B. Goss, 7627 Beach Cove La.; William D. Morrow, 10206 Amblewood, both of Houston, Tex. 77072

[21] Appl. No.: 892,018

[22] Filed: Mar. 31, 1978

[51] Int. Cl.[2] ..... B66C 23/84

[52] U.S. Cl. ..... 212/70; 308/238; 308/DIG. 10; 29/402.08; 29/427

[58] Field of Search ..... 212/66–70; 29/401 F, 426, 427; 308/238, 58, 61, DIG. 10

[56] References Cited

U.S. PATENT DOCUMENTS

| | | | |
|---|---|---|---|
| 2,414,573 | 1/1947 | Wagner et al. | 212/70 |
| 3,148,778 | 9/1964 | Fox et al. | 212/70 |
| 4,061,230 | 12/1977 | Goss et al. | 212/70 |

*Primary Examiner*—Albert J. Makay

*Attorney, Agent, or Firm*—Pravel, Gambrell, Hewitt, Kirk, Kimball & Dodge

[57] ABSTRACT

The method for removing a bearing assembly disposed between a revolving turntable of a pedestal crane assembly and the pedestal and a removable bearing assembly for a pedestal crane, wherein the method includes activating a support member coacting between the revolving turntable and the upper end of the pedestal for raising and supporting the pedestal crane assembly from the support column of the pedestal, centering the revolving turntable about the support column of the pedestal with alignment structure, removing a retainer plate that secures thrust and radial bearings in position with respect to the revolving turntable and the upper end of the pedestal to permit access and removal of the bearings.

13 Claims, 7 Drawing Figures

METHOD FOR REMOVING A BEARING ASSEMBLY OF A PEDESTAL CRANE AND A REMOVABLE BEARING ASSEMBLY FOR A PEDESTAL CRANE

BACKGROUND OF THE INVENTION

The field of this invention is pedestal crane bearing systems, particularly of the type providing bearing surfaces between the upperworks of the pedestal crane assembly and the pedestal.

Prior art crane bearing systems typically require the use of large, machined shear ball bearings mounted on or adjacent to the upper perimeter of the pedestal. These shear ball bearings provide for rotation of the upperworks about the pedestal as well as support the upperworks against all stresses and strains encountered due to loading on the crane boom. Typically, such shear ball bearings are difficult to replace requiring additional heavy duty machinery for removing the pedestal crane assembly from the pedestal itself to allow access to the worn or damaged bearing components.

Prior art devices include those bearing structures disclosed in U.S. Pat. Nos. 46,213; 884,666; 2,414,573; 2,825,471; 3,148,778; 3,258,130; and, West German Patent Nos. 1,195,918 and 2,025,169. All such references disclose various bearing arrangements; however, none address the specific problem or difficulties encountered in the removal and maintenance of such bearings located adjacent to the upper end of the pedestal or those located about the exterior perimeter of the pedestal. U.S. Pat. No. 4,061,230 to the inventors of the instant invention, while recognizing the problem, provides different bearing structure for supporting the pedestal crane assembly about the support column of the pedestal. However, this reference does not contemplate nor teach a unitary structure or method for permitting ease of access to such bearings for inspection or removal.

SUMMARY OF THE INVENTION

The present invention relates to a new and improved method for removing a bearing assembly of a pedestal crane and a removable bearing assembly for a pedestal crane. The method of the present invention preferably includes activating a support member capable of coacting with and between the revolving turntable of the pedestal crane assembly and the upper end of the pedestal, for raising and supporting the weight of the pedestal crane assembly from the support column of the pedestal, centering the revolving turntable about the support column with alignment means, removing a retainer plate capable of securing radial and thrust bearings in position with respect to the revolving turntable and the upper end of the pedestal and thereafter withdrawing the bearings from the support column and revolving turntable to permit inspection thereof.

DESCRIPTION OF THE PREFERRED EMBODIMENT

Figure 1:
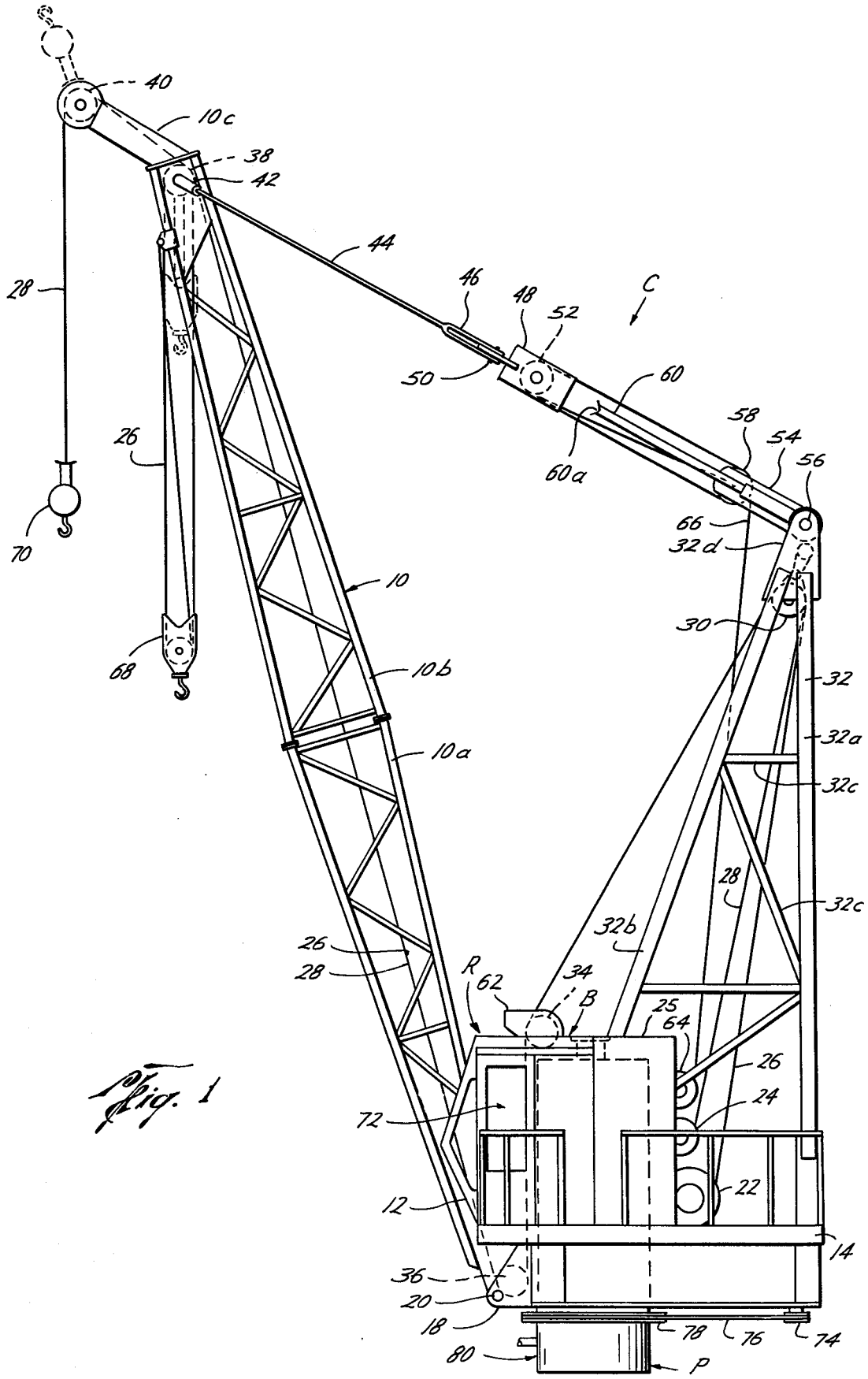
FIG. 1 is an elevational view of a pedestal crane, showing a pedestal crane assembly about a pedestal.

In the drawings, the letter B designates the removable bearing assembly of the present invention. The bearing assembly B is adapted to be disposed between a revolving turntable R and a pedestal P for providing appropriate bearing surfaces therebetween. The bearing assembly B is not only effective for utilitarian purposes but also for facilitating ease of inspection and removal thereof. Unless otherwise noted, the components of this invention are made of steel capable of taking heavy stresses and strains without failure, although other suitable high-strength materials may be used if desired.

As shown in FIG. 1, the pedestal crane assembly C preferably includes a boom designated generally as 10 being movably affixed to the upperworks, designated generally as 12, which is adapted to be disposed about the pedestal P. The pedestal P may be mounted with an offshore platform, permanently embedded in the ground, mounted with a movable vehicular frame or in any other way rigidly affixed to a supporting structure (not shown). The upperworks 12 generally includes a platform 14 affixed to an appropriate cylindrical sleeve 16 (FIG. 2) which is adapted to be disposed about the pedestal P. The cylindrical sleeve 16 is affixed to the revolving turntable R, which in turn is mounted for movement about the pedestal P.

The cylindrical sleeve 16, in addition to supporting the platform 14, also provides an appropriate boom support 18 wherein the boom 10 may be pivotally mounted therewith by means of pin point 20. Preferably, as shown in FIG. 1, the main hoist 22 and auxiliary hoist 24 are mounted with an appropriate shelter 25 mounted on the platform 14. Main hoist line 26 and auxiliary hoist line 28 extend from the main hoist 22 and auxiliary hoist 24, respectively, up and into sheave 30 supported by boom tower 32 adjacent upper end **32*d* thereof. Hoist lines 26, 28 extend from the sheave 30 over idler sheave 34, preferably mounted with the shelter 25, therefrom idler sheave 34 to idler sheave 36 which is preferably mounted with the platform 14 adjacent pin joint 20. From sheave 36, the hoist lines 26, 28 are located along the length of and therethrough the central portion of the boom 10 to sheaves 38 and 40, respectively. As is known, the boom 10 may be made up of multiple sections such as boom sections 10*a*, 10*b* or any number of additional sections in addition thereto (not shown) that would be appropriate for the given job to be done. As shown in FIG. 1, boom section 10*a* is pivotably mounted with the platform 14 adjacent pin joint 20, with sections 10*a*, 10*b* being appropriately fastened together at the mid-point of the boom 10. Sheaves 38, 40 are appropriately affixed with the boom 10 adjacent the boom tip, designated generally as 10*c***.

Preferably, the boom tower 32 is appropriately affixed with the platform 14 of the upperworks 12 with the boom tower 32 having appropriate support members 32*a*, 32*b* and appropriate bracing 32*c* therebetween to provide the necessary structural strength therefor. As noted hereinabove, the boom tower 32 supports sheave 30 adjacent the upper end 32*d* and also provides support for the mechanism necessary for changing the boom angle of the boom 10 with respect to the platform 14 and pedestal P. A connector 42 pivotally affixes the boom tip 10*c* to an appropriate cable 44 which in turn has clevis 46 attached thereto. Clevis 46 is pinned to housing 48 by pin 50, with the housing 48 having sheave 52 mounted therein. Support arms 54 are pivotally mounted with the upper end 32*d* of the boom tower 32 by pin 56, with support arms 54 supporting sheave 58. Boom stop 60 is further mounted with the upper end 32*d* of boom tower 32 by pin 56 with end 60*a* adapted to engage sheave 52 upon vertical disposition of the boom 10. Boom stop 62 mounted with the shelter 25 also provides a positive, fail-safe, metal-to-metal type boom stop for limiting movement of the boom 10 to a vertical disposition.

Elevation of the boom 10 is controlled by boom hoist 64 preferably mounted with shelter 25, with the boom hoist 64 having boom hoist line 66 extending from hoist 64 to sheave 58 and thereafter threaded between sheaves 52 and 58. Withdrawal of boom hoist line 66 by boom hoist 64 results in the boom 10 being appropriately elevated while conversely, if the boom hoist 64 reels out boom hoist line 66, then the boom 10 is appropriately lowered, changing the relative boom angle of the boom 10.

Loads (not shown) are adapted to be picked up and moved about by the pedestal crane assembly C by means of either the travelling block 68 operatively connected to the main hoist line 26 and/or the ball-hook assembly 70 operatively connected with the auxiliary hoist line 28. It will be appreciated that the routing of the main hoist line 26 and auxiliary hoist line 28 about sheave 36 and through the length of the boom 10, allows the boom 10 to be raised and/or lowered with a corresponding change in relative boom angle while the relative distance of the travelling block 68 and/or ball-hook assembly 70 from the boom tip 10*c* remains substantially constant, preventing "two-blocking" of the travelling block 68 or ball-hook assembly 70 when the boom 10 is lowered. As is known, "two-blocking" occurs when the block 68 or assembly 70 actually engages the boom tip 10*c*, causing damage thereto, typically occurring while the boom 10 is being lowered. The specific structural details surrounding the arrangement of the travelling block 68 and ball-hook assembly 70 as it pertains to the boom tip 10*c* of the boom 10 is the subject of another copending application.

The platform 14 preferably provides adequate space for the heavy equipment necessary for crane operation. This includes, as noted hereinabove, the various hoists such as hoists 22, 24, 64. Other equipment, for example, an appropriate engine (not shown) may be mounted on platform 14 to provide motive power for a hydraulic pump (not shown) which may provide fluid power for operation of hoists 22, 24, 64. Of course, should the hoists be electrically operated, the engine could provide power to a generator (not shown) located on the platform 14 to provide such proper electrical motive power for powering the same. The platform 14 provides an appropriate location for the controls necessary for the operator to manipulate and control the pedestal crane assembly C. Preferably, the controls may be located within the shelter 25 adjacent a location designated as 72. Still further, the platform 14 provides the support for equipment necessary for rotating the pedestal crane assembly C about the pedestal P. This, by way of example, may include power means such as a hydraulic motor (not shown) mounted with platform 14 for powering an appropriate bull gear 74, with the power means driving power through power transfer means such as an appropriately sized chain 76, which in turn, engages tooth gears 78 (FIGS. 1, 2, 3) which are permanently affixed with the pedestal P. Action of the power means causes movement of the platform 14 about the pedestal P.

The bearing assembly B of the present invention is adapted to be disposed between the revolving turntable R of the pedestal crane assembly C and the pedestal P. The pedestal P includes pedestal 80 which is preferably of a cylindrical configuration. The pedestal 80 is formed having an upper end 80*a* and lower end 80*b*. The lower end 80*b* may be appropriately affixed to any support as noted hereinabove. The upper end 80*a* preferably has an appropriate turntable support plate 80*c* mounted therewith, having bearing support plate 80*d* mounted on turntable support plate 80*c*. Support column 80*e* is preferably rigidly affixed with the bearing support plate 80*d*. Stop plate 80*f* is removably mounted with the upper end of support column 80*e* by suitable fasteners 80*g*, extending through openings 80*i* formed in plate 80*f* and thereinto threaded openings 80*j* in support column 80*e* as described more fully hereinbelow. A suitable recess 80*h* is preferably formed in the pedestal 80 slightly above the point of mounting gears 78 as described more fully hereinbelow. Internal piping 80*k* of pedestal 80 permits the connection of auxiliary equipment (such as communications, hydraulics and/or electrical lines from supporting structure) not originating with the pedestal crane assembly C but capable of being connected thereto while not interfering with rotation of the pedestal crane assembly C about the pedestal P.

The bearing means B of the present invention is adapted to be mounted with the pedestal P. The bearing means B includes thrust bearing 82 which is formed having a suitably sized opening 82*a* therein such that the thrust bearing 82 may be slipped over support column 80*e*. Preferably, the support column 80*e* is of a cylindrical configuration and accordingly, the opening 82*a* would also be of a circular configuration, with the inside diameter of the opening 82*a* being slightly larger than the outside diameter of the support column 80*e*. The thrust bearing 82 is adapted to rest upon bearing support plate 80*d*. The thrust bearing 82 may be formed of any suitable material, however, it is preferred that material manufactured by Polymer Corporation of Reading, Pa. under the trademark "Nylatron" be used. "Nylatron" is a nylon material that is impregnated with molybdenum disulfide.

The bearing means B also includes a radial bearing 84 having an opening 84*a* of similar diameter to that of opening 82*a* formed with the thrust bearing 82 such that the radial bearing 84 may also be mounted about the support column 80*e*. It is preferred that the radial bearing 84 be of a rectangular configuration or of any other suitable desired configuration and is preferably of "Nylatron". Lastly, a retainer plate 86 is adapted to be disposed about the support column 80*e* with the retainer plate 86 having an opening 86*a* formed centrally thereof and of slightly greater diameter than that of openings 84*a* and 82*a* such that it may be readily disposed about the support column 80*e*.

Figure 2:
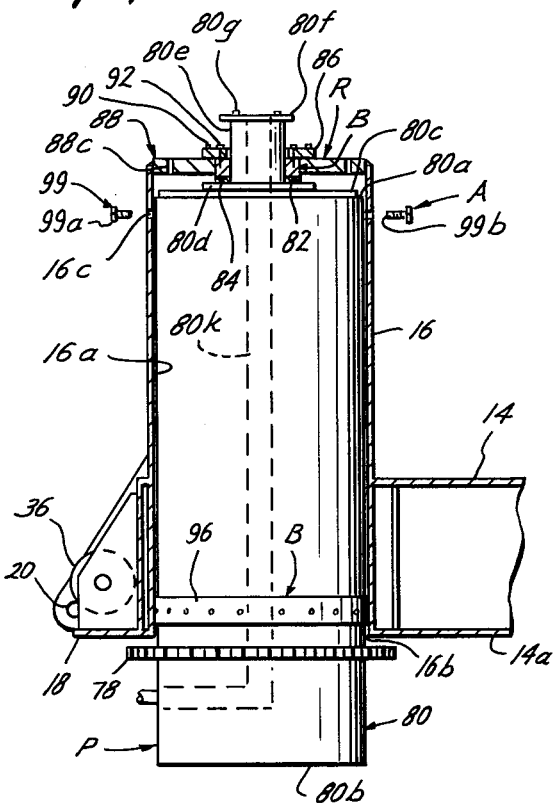
FIG. 2 is an elevational, sectional view of the pedestal and a portion of the pedestal crane assembly, showing primary features of the radial, thrust, and annular bearings of the present invention in relation to the pedestal crane assembly and pedestal.
Figure 3:
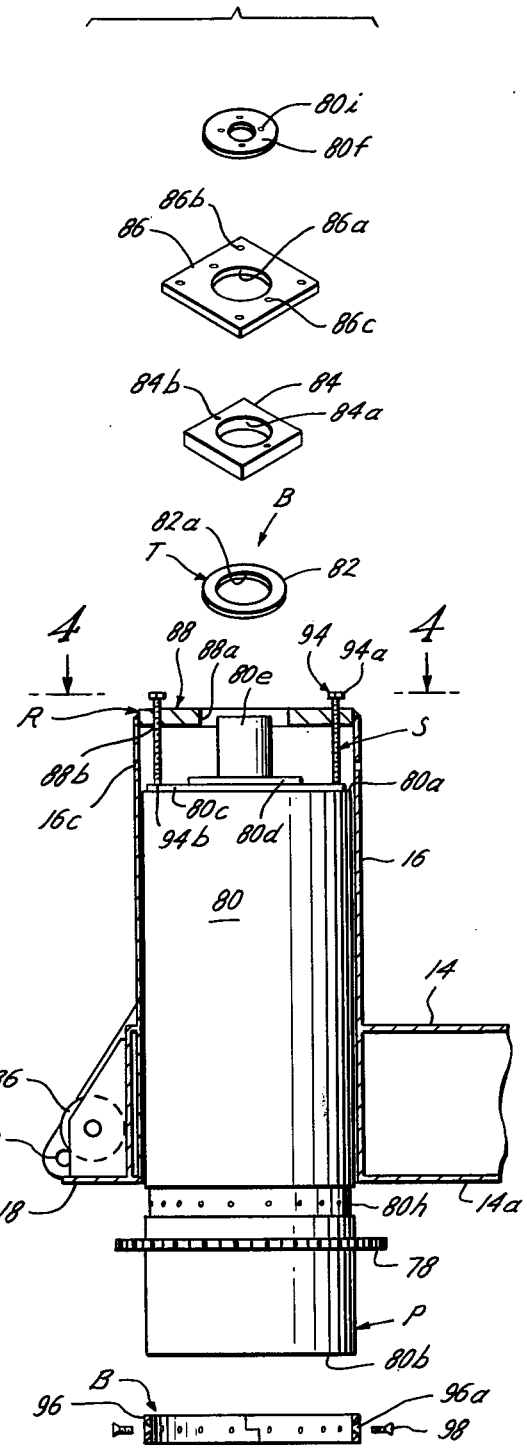
FIG. 3 is an exploded view of structure as shown in FIG. 2.
Figure 4:
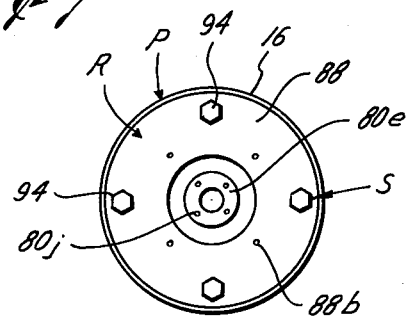
FIG. 4 is a plan view of FIG. 3, taken along the lines 4—4 of FIG. 3 of the revolving turntable of the present invention.

The revolving turntable R includes turntable 88 which is adapted to be rigidly affixed with cylindrical sleeve 16 of the pedestal crane assembly C. The turntable 88 preferably is formed having a suitably shaped opening 88*a* in the central portion thereof with the opening 88*a* conforming substantially to the exterior configuration and size of the radial bearing 84. Thus, for example, if the radial bearing 84 is of a rectangular configuration, as shown in FIG. 3, then accordingly, opening 88*a* must also be of such a rectangular configuration such that the radial bearing 84 may be mounted therein as shown in FIG. 2.

The retainer plate 86 is adapted to be removably mounted with the turntable 88 by means of suitable fasteners 90 extending through openings 86*b* formed in the retainer plate 86 thereinto suitable threaded openings 88*b* formed in the turntable 88. Removable fasteners 92 are adapted to extend through suitably formed openings 86*c* formed in retainer plate 86 thereinto threaded openings 84*b* in radial bearing 84 for removably mounting the radial bearing 84 with the retainer plate 86 as desired and discussed more fully hereinbelow.

The support means S of the present invention includes threaded bolts 94 which are receivable in threaded openings 88*c* formed in turntable 88. The threaded bolts 94 are threaded for movement with respect to openings 88*c*.

The bearing assembly B of the present invention further includes an annular bearing 96 which is adapted to be disposed within recess 80*h* formed in pedestal 80. It is preferred that annular bearing 96 is of a ultra-high molecular weight polyolefin that is manufactured by Polymer Corporation of Reading, Pa. Preferably, the rectangular cross section of the annular bearing 96 is such that the height of the annular bearing 96 is slightly less than that of the recess 80*h* allowing the annular bearing 96 to be mounted therein the recess 80*h*, with, however, the outside diameter of the annular bearing 96 as mounted being greater than that of the outside diameter of the pedestal 80 such that the annular bearing 96 projects radially outwardly from the outer surface of the pedestal 80 to engage the inside diameter of 16*a* of the cylindrical sleeve 16, adjacent the lower portion 16*b* thereof. Suitable fasteners 98, such as brass screws or the like, are adapted to be received in like formed openings 96*a* in the annular bearing 96 and in recess 80*h* for suitably affixing the annular bearing 96 thereto while additionally accommodating ease in removal thereof. It is preferred that the heads of such fasteners 98 fall below the surface of the annular bearing 96 such that no fastener 98 extends beyond the outside diameter of the annular bearing 96.

The alignment means A of the bearing assembly B of the present invention includes threaded bolts 99 that are adapted to be received within threaded openings 16*c* formed in the cylindrical sleeve 16 such that upon threading the threaded bolts 99 into the threaded openings 16*c*, the bolts 99 will engage the outer annular surface of the pedestal 80, as discussed more fully hereinbelow.

In practicing the method for removing the bearing assembly B for the pedestal crane assembly C of the present invention, it is preferred that the boom 10 be disposed at such an angle of inclination that the entire pedestal crane assembly C is balanced about the support column 80*e* of the pedestal 80 to minimize lateral or torque forces exerted by the pedestal crane assembly C on the pedestal 80 adjacent the support column 80*e*. This balancing of the pedestal crane assembly C in effect neutralizes the entire assembly's weight about the column support 80*e*.

Once the pedestal crane assembly is essentially balanced about the support column 80*e* of the pedestal 80, it is preferred that the revolving turntable R be centered about the support column 80*e* with the pedestal 80 with alignment means A mounted with the pedestal crane assembly C, the alignment means A being capable of engaging the pedestal for the centering thereof. Thus, upon rotating the heads 99*a* of the bolts 99, which are received in openings 16*c*, results in the end portions 99*b* of the bolts 99 engaging the outer annular surface of the pedestal 80 adjacent the upper end 80*a* to cause a slight lateral shifting of the revolving turntable R of the pedestal crane assembly C about the pedestal P. This insures that the pedestal crane assembly C is centered and aligned with the pedestal P about support column 80*e*.

After balancing and aligning the pedestal crane assembly C about the pedestal P, preferably the power transfer means, such as chain 76, is removed and/or loosened to allow for the hereinafter described movement of the pedestal crane assembly C.

After this removal and/or loosening, it is preferred that the support means S, coacting with and between the revolving turntable R and the upper end 80*a* of the pedestal 80, be utilized for raising and supporting the weight of the pedestal crane assembly C from the support column 80*e* of the pedestal P. The support means S includes threaded bolts 94 which are adapted to be threadedly received in threaded openings 88*b* in turntable 88. By rotating the head 94*a* of bolts 94, the lower end 94*b* engages the turntable support plate 80*c* formed with the pedestal 80. As is shown, a plurality of bolts 94 may be used such that the lower end 94*b* of the bolts 94 may be alternately rotated for uniform engagement of the bolts 94 with the turntable support plate 80*c* to permit substantially vertical movement of the revolving turntable R, hence pedestal crane assembly C, with respect to the pedestal P. Continued threading of the support means S causes upward vertical movement of the pedestal crane assembly C. The upward movement of the pedestal crane assembly C is limited by either the length of the threaded bolts 94 and/or the retainer plate 86 engaging the stop plate 80*f*. However, the amount of travel of the pedestal crane assembly C is not particularly important as long as all loading on the bearing assembly B of the present invention is removed and no lateral or vertical forces are present on either the thrust bearing 82 or radial bearing 84.

Once all loading is taken off the bearing assembly B of the present invention, the retainer plate 86, which secures the bearing assembly B in position with respect to the revolving turntable R and the upper end 80*a* of the pedestal 80, is removed to permit access to the bearing assembly B of the present invention. In order to effectuate removal of the radial bearing 84 and thrust bearing 82, it is necessary that the fasteners 80*g* be removed such that the stop plate 80*f* may be removed from the support column 80*e* of the pedestal. Thereafter, fasteners 90, securing the retainer plate 86 with the revolving turntable R, are removed so that the retainer plate 86 having the radial bearing 84 attached thereto by fasteners 92 may be removed as a unit from the support column 80*e* of the pedestal 80. An alternative procedure may also be used such that the fasteners 92 are removed prior to removal of fasteners 90 such that the retainer plate 86 may be removed without the radial bearing 84 being attached thereto; however, the former procedure is preferred.

The retainer plate 86 and radial bearing 84 once removed provide access to the thrust bearing 82 for its removal. Thus, the bearing assembly B, including the radial bearing 84 and thrust bearing 82 are withdrawn from the support column 80*e* of the pedestal P to permit inspection thereof. As a consequence, both the thrust bearing 82 and radial bearing 84 may accordingly be inspected for wear, damage or any failures thereof that may have occurred during operation of the pedestal crane assembly C of the present invention. It will be appreciated that no external nor auxiliary lifting source, such as a crane or the like is necessary in gaining access to and/or for permitting the inspection of the bearing assembly B of the present invention. If the bearing assembly B is damaged then such should be repaired or preferably replaced.

It should be noted that upon activating the support means S and the consequent raising the pedestal crane assembly C from the pedestal P as shown in FIG. 3, the lower portion 14*a* of the platform 14 is at a position slightly above the recess 80*h* formed on the pedestal 80 such that access may be had to bearing means B including the annular bearing 96, for inspection thereof. Should removal be necessary or warranted, then the fasteners 98 need simply be removed, with the annular bearing 96 thereafter being replaceable. Replacement is accomplished by merely fitting a new annular bearing 96 appropriately into recess 80*h* and thereafter inserting fasteners 98 through annular bearing 96 to be resecured with the pedestal 80.

Upon completion of inspection, removal and/or replacement of the bearing means B including the thrust bearing 82 and the radial bearing 84, the thrust bearing 82 is thereafter disposed about the support column 80*e*. Fasteners 92 are used to affix the radial bearing 84 with the retainer plate 86 with this assembly being thereafter placed about the support column 80*e*. The fasteners 92 prevent the radial bearing 84 from becoming detached from the retainer plate 86 and also insure proper alignment of the radial bearing 84 in the opening 88*a* formed in revolving turntable 88. Thereafter, the retainer plate 86 is secured with the revolving turntable 88 by fasteners 90 which are adapted to be received in the threaded openings 88*d* formed in the turntable 88. Thereafter, the support means S, including threaded bolts 94, is thereafter retracted (unthreaded) such that the pedestal crane assembly C is thereafter lowered to the original position as shown in FIG. 2 wherein the weight of the pedestal crane assembly C is supported by the thrust bearing 82 and radial bearing 84. Thereafter, the alignment means A, including plural bolts 99 is retracted (unthreaded) to prevent interference of operation with the pedestal crane assembly C of the present invention. Thus, the method for removal of the present invention envisions an uncomplicated process whereby the thrust bearing 82, radial bearing 84 and annular bearing 96 may be inspected and removed without the aid of any heavy external equipment.

Figure 5:
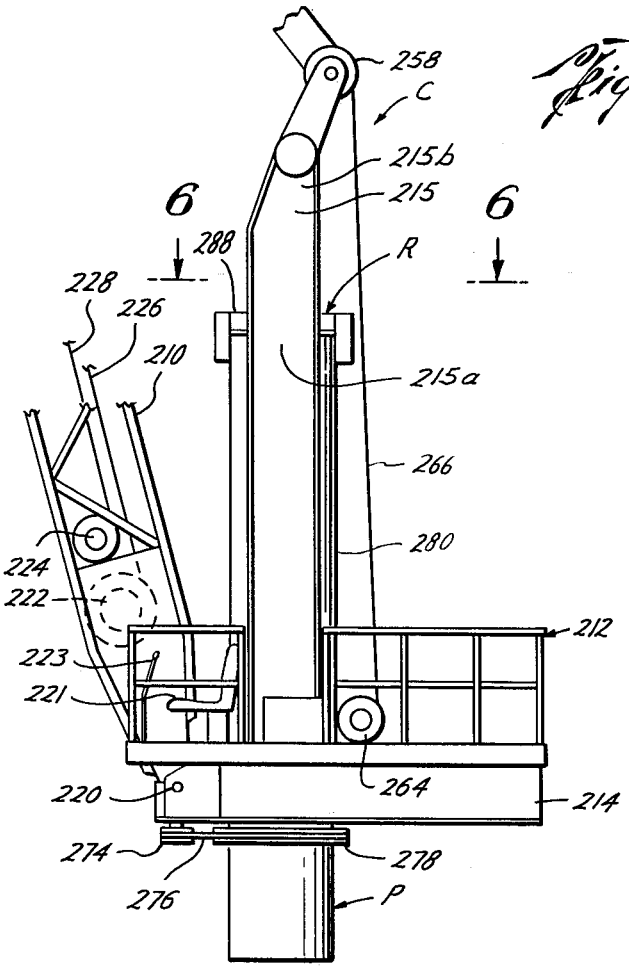
FIG. 5 is an elevational view similar to FIG. 1 of a portion of an alternative pedestal crane assembly as disposed about a pedestal.
Figure 6:
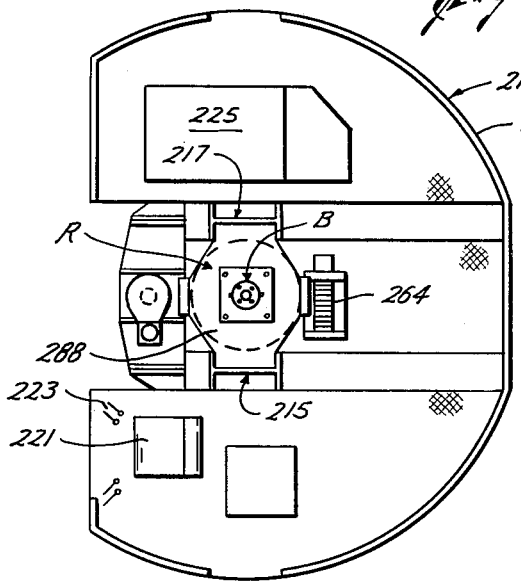
FIG. 6 is a plan view of the platform of the pedestal crane assembly of FIG. 5, as taken along the lines 6—6 of FIG. 5; and, FIG. 7 is an elevational, sectional view similar to FIG. 2 of the pedestal crane assembly and pedestal as shown in part in FIG. 5, detailing the removable bearing assembly of the present invention.
Figure 7:
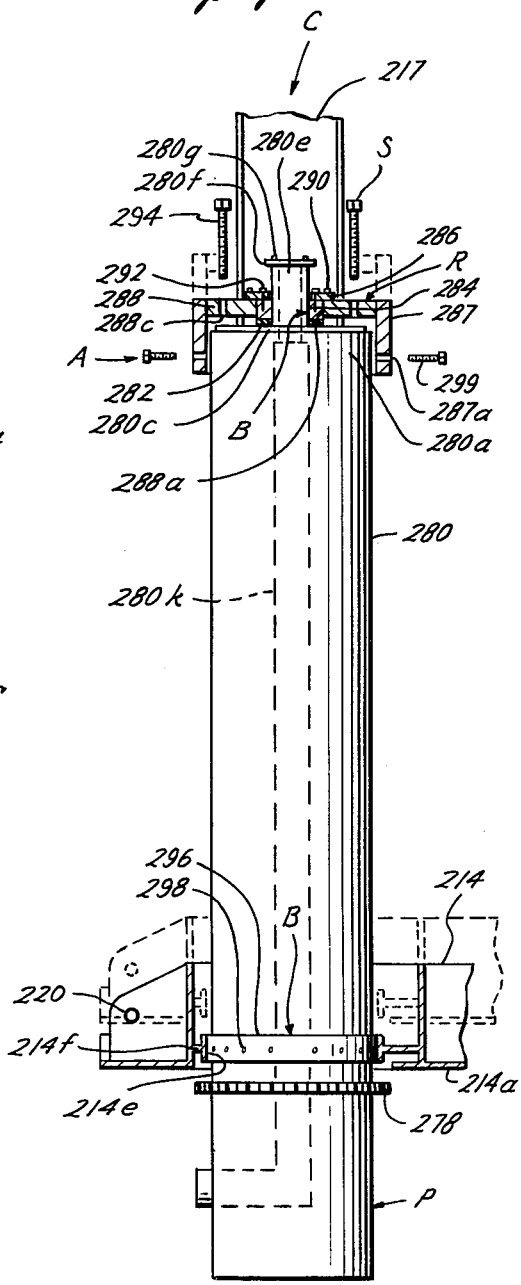

A second embodiment of the pedestal crane assembly C of the present invention is shown in FIGS. 5–7. Parts for the pedestal crane assembly of FIGS. 5–7, corresponding to those of FIGS. 1–4 will be labeled with the same identifying numbers, with the two-digit numbers of FIGS. 1–4 being preceded by "2" such that the numeral designations of the identified parts will span between 210–299. That structure that is different will use heretofore undesignated numerals in the 200 series.

As shown in FIG. 5, the pedestal crane assembly C includes a boom 210 pivotally affixed with upperworks, generally designated 212, and specifically attached to the platform 214 adjacent pin joint 220. The upperworks 212 is adapted to be disposed about the pedestal P. Instead of cylindrical sleeve 16 as per FIGS. 1–4, I-beams 215, 217 are affixed with the platform 214 and extend upwardly therefrom to where the revolving turntable R is mounted adjacent the upper end thereof. The revolving turntable R or turntable 288, is adapted to be affixed between the internal webs of I-beams 215, 217 adjacent intermediate portions 215*a*, 217*a*. The upper ends 215*b*, 217*b* of I-beams 215, 217 provide support for sheave 258 which receives boom hoist line 266 from boom hoist 264 mounted preferably with the platform 214, with the boom hoist 264 being for controlling the angle of inclination of the boom 210. Preferably, the main hoist 222 is mounted within the boom 210 as is auxiliary hoist 224. This permits the main hoist line 226 and auxiliary hoist line 228 to run along the length of and within the boom 210 to prevent "two-blocking" as discussed above.

The platform 214 is preferably of a substantially circular configuration as shown in FIG. 6. This circular configuration of the platform 214 permits the greatest amount of working area utilizing the minimum amount of swing-space. Many prior art cranes utilize substantially square rather than circular platforms which not only increase the amount of working space necessary to provide for proper rotation thereof, but also reduces the amount of area that may be correspondingly used for usable work space. The platform 214 preferably has operator's chair 221 mounted thereon having controls 223 adjacent thereto. Also, preferably positioned on the platform 214 is appropriate motive power 225 capable of providing mechanical, fluid or electric power as desired. The motive power 225 may include a diesel engine or the like which provides the suitable power for powering the boom hoist 264, main hoist 222 and/or auxiliary hoist 224 in addition to drive 274. The assembly of the chain 276 which engages drive 274 and gears 278 affixed to the pedestal P provides for rotational movement of the platform 214 about the pedestal P, as desired.

As shown in FIG. 7, the bearing assembly B is similar to that as described hereinabove with regard to the embodiment of FIGS. 1–4. The pedestal crane assembly C is adapted to be disposed about pedestal 280 with the revolving turntable R adapted to be disposed about the support column 280*e* of the pedestal 280. The revolving turntable R includes turntable 288 having skirt 287 appropriately formed therewith. Preferably, the skirt 287 is of a cylindrical configuration being slightly larger in inside diameter than the outside diameter of the pedestal 280 having appropriate threaded openings 287*a* formed therein and adapted to receive threaded bolts 299, which comprise the alignment means A of the present invention. The turntable 288 is formed with a central opening 288*a* which is preferably of a rectangular configuration and is adapted to receive radial bearing 284 therein. The turntable 288 further includes threaded openings 288*c* which are capable of receiving bolts 294 which comprise the support means S of the present invention. Thrust bearing 282 is adapted to be disposed between the radial bearing 284 and the turntable support plate 280*c*. The retainer plate 286 is secured to the turntable 288 by fasteners 290 and is also secured to the radial bearing 284 by fasteners 292. Furthermore, stop plate 280*f* is secured to the support column 280*e* of the pedestal 280 by appropriate fasteners 280*g*.

The pedestal 280 is also formed with a suitable recess (not shown) adapted to receive annular bearing 296 which is preferably secured thereto by suitable fasteners 298. The annular bearing 296 is adapted to be engaged by a cylindrically shaped, bearing ring 214*e* affixed to the platform 214 by an appropriate flange 214*f*, with the bearing ring 214*e* adapted to engage the annular bearing 296.

In the use or operation of the method for removing the bearing assembly of the present invention, as described hereinabove, the boom 210 should be disposed at a proper angle of inclination such that the pedestal crane assembly C is substantially balanced about the support column 280*e* of the pedestal 280 to minimize lateral and torque forces exerted by the pedestal crane assembly C on the pedestal P adjacent thereto. Thereafter, the alignment means A is used to center the revolving turntable R about the support column 280*e* of the pedestal 280 such that bolts 299 engage the exterior surface of the pedestal 280 adjacent the upper end 280*a* thereof to insure this centering action. Thereafter, the chain 276 should be appropriately loosened or removed from the gears 274, 278 to allow the pedestal crane assembly C to move vertically in response to action of the support means S. The support means S is activated such that there is coaction between the turntable 288 and the pedestal support plate 280*c* of the pedestal 280 by bolts 294, adjacent the upper end 280*a* of the pedestal 280 for raising and supporting the weight of the pedestal crane assembly C from the support column 280*e* of the pedestal 280. Activating the support means, namely threading bolts 294, downwardly to such a position where they engage the turntable support plate 280*c*, results in vertical movement of the pedestal crane assembly C with respect to the pedestal P which removes loading of the thrust bearing 282, radial bearing 284 and annular bearing 296. Further, upon appropriate movement of the support means, and corresponding movement of the pedestal crane assembly, to that position shown in the dotted lines in FIG. 7, results in the annular bearing 296 being exposed for removal and inspection thereof.

With the loading on the bearing assembly B of the present invention being removed, the fasteners 290 may be removed allowing removal of the retainer plate 286 having the radial bearing 284 therewith, thereafter permitting removal of the thrust bearing 282. Removal of fasteners 292 permits separation of the retainer plate 286 and radial bearing 284. Radial bearing 284 and thrust bearing 282 may thereafter be inspected for damage, wear and perhaps the necessary replacement thereof. Upon appropriate inspection and/or replacement thereof, the thrust bearing 282 may thereafter be placed about the support column 280*e*. Thereafter, the radial bearing 284, affixed with the retainer plate 286 by fasteners 292 is positioned about support column 280*e* and lowered into opening 288*a* formed in turntable 288, with the retainer plate 286 thereafter being affixed to the turntable 288 by fasteners 290. Similarly, replacement of the annular bearing 296 may be accomplished by removal of fasteners 298, removal of the old and inserting a new annular bearing 296, with the consequent reinsertion of the fasteners 298 threrethrough the annular bearing 296 and thereinto the pedestal 280 for resecuring thereof. Thereafter, the support means S, including bolts 294, may be reactivated in such a fashion that the pedestal crane assembly C is accordingly lowered back into its original, operational position. This is accomplished by rotating the bolts 294 in such a fashion as to unthread them from the threaded openings 288*c* formed in the turntable 288. Thereafter, the chain 276 must be appropriately repositioned and the alignment means A withdrawn. Alignment means A may be withdrawn by unthreading of the threaded bolts 299 from within the threaded openings 287*a* formed in the skirt 287.

Thus, the method for removing the bearing assembly B and the removable bearing assembly B itself of the present invention provide a new and improved method and apparatus for changing out the critical, load-intensive bearings of a pedestal crane.

The foregoing disclosure and description of the invention are illustrative and explanatory thereof, and various changes in the size, shape and materials as well as in the details of the illustrated construction may be made without departing from the spirit of the invention.

We claim:

1. For a pedestal crane assembly having a revolving turntable and a boom, the revolving turntable adapted to be movably disposed on a support column of a pedestal, a method for removing a thrust bearing assembly disposed between the revolving turntable and the pedestal, comprising the steps of:

centering the revolving turntable about the support column of the pedestal with alignment means mounted with the pedestal crane assembly, the alignment means being capable of radially engaging the pedestal for said centering;

activating a support means coacting with and between the revolving turntable and the upper end of the pedestal for raising and supporting the weight of the pedestal crane assembly from the support column of the pedestal;

removing a retainer plate that secures the thrust bearing assembly in position with respect to the revolving turntable and the upper end of the pedestal to permit removal and access to the thrust bearing assembly; and, withdrawing the thrust bearing assembly from the pedestal to permit inspection thereof.

2. The method of claim 1, wherein said withdrawing includes the steps of:

removing a radial bearing from the support column, said radial bearing being disposed in an opening formed in the revolving turntable and mounted for rotatable movement about the support column; and, thereafter removing a thrust bearing from the support column, said thrust bearing being disposed about the support column between the upper end of the pedestal and the radial bearing.

3. The method of claim 2, further including the step of:

replacing the thrust bearing assembly after said removing thereof if the existing thrust bearing assembly is damaged or worn.

4. The method of claim 1, wherein:

said removing includes removing the retainer plate with the radial bearing removably affixed thereto.

5. The method of claim 1, wherein the pedestal crane assembly includes a platform, further including the step of:

inspecting an annular bearing disposed between the platform and the pedestal, after said activating.

6. The method of claim 5, further including the step of:

removing the annular bearing disposed between the platform and the pedestal after said inspecting, as desired.

7. The method of claim 1, wherein said activating includes the step of:

threading a plurality of bolts through suitable openings formed in the revolving turntable so as to engage the upper end of the pedestal for raising and supporting the weight of the pedestal crane assembly from the support column of the pedestal.

8. The method of claim 1, further including the step of:

balancing the pedestal crane assembly about the pedestal by movement of the boom to substantially balance the pedestal crane assembly about the support column to minimize forces exerted by the pedestal crane assembly on the pedestal adjacent the column support prior to said activating.

9. The method of claim 8, wherein the pedestal crane assembly includes upperworks supported by the revolving turntable, the upperworks having power means therewith for engaging power transfer means which engages the pedestal for revolving the upperworks about the pedestal, further including the step of:

loosening the power transfer means prior to said activating and after said centering.

10. In a pedestal crane assembly having a revolving turntable and a boom, the revolving turntable adapted to be disposed on a support column of a pedestal, a bearing assembly adapted to be disposed between the revolving turntable and the support column, comprising:

support means coacting with and between the revolving turntable and the upper end of the pedestal for raising and supporting the weight of the pedestal crane assembly from the support column of the pedestal;

alignment means mounted with the pedestal crane assembly for centering the revolving turntable about the support column of the pedestal, said alignment means radially engaging the pedestal for centering the pedestal crane assembly about the pedestal;

thrust bearing means adapted to be disposed about the support column of the pedestal; and, retaining means removably mounted with the revolving turntable for securing the thrust bearing means in position with respect to the revolving turntable and the upper end of the pedestal to permit removal and accesss to said thrust bearing means.

11. The bearing assembly of claim 10, wherein said thrust bearing means includes:

a radial bearing adapted to be disposed in an opening formed in the revolving turntable, said radial bearing mounted for rotatable movement about the support column and being removable from the revolving turntable and the support column; and, a thrust bearing being removably disposed about the support column adjacent the upper end of the pedestal for providing the wear surface between the upper end of the pedestal and said radial bearing.

12. The bearing assembly of claim 10, wherein:

said support means includes a plurality of bolts adapted to be threadedly received in suitable openings formed in the revolving turntable, said bolts adapted to engage the upper end of the pedestal for raising and supporting the weight of the pedestal crane assembly from the support column of the pedestal.

13. The bearing assembly of claim 10, wherein the pedestal crane assembly further includes a cylindrical sleeve affixed to the revolving turntable and adapted to be disposed about the pedestal, the bearing assembly further including:

an annular bearing disposed between the cylindrical sleeve of the pedestal crane assembly and a portion of the pedestal beneath the upper end thereof for providing a bearing surface between the cylindrical sleeve of pedestal crane assembly and the pedestal.

* * * * *